US009876332B2

(12) United States Patent
Kawai

(10) Patent No.: US 9,876,332 B2
(45) Date of Patent: Jan. 23, 2018

(54) SPARK PLUG CAPABLE OF RESTRAINING LATERAL SPARKING

(71) Applicant: NGK SPARK PLUG CO., LTD., Nagoya, Aichi (JP)

(72) Inventor: Tomoki Kawai, Iwakura (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/606,588

(22) Filed: May 26, 2017

(65) Prior Publication Data

US 2017/0346259 A1 Nov. 30, 2017

(30) Foreign Application Priority Data

May 30, 2016 (JP) ..... 2016-107857

(51) Int. Cl.
*H01T 13/20* (2006.01)
*H01T 13/36* (2006.01)
*H01T 13/41* (2006.01)

(52) U.S. Cl.
CPC ..... *H01T 13/36* (2013.01); *H01T 13/20* (2013.01); *H01T 13/41* (2013.01)

(58) Field of Classification Search
CPC ..... H01T 21/02; H01T 13/39; H01T 13/38; H01T 13/20; H01T 13/34; H01T 13/36; H01T 13/467; H01T 13/05
See application file for complete search history.

(56) References Cited

U.S. PATENT DOCUMENTS

2015/0188293 A1 7/2015 Ozeki et al.
2016/0177889 A1 6/2016 Matsubara et al.
2016/0233648 A1 8/2016 Fukuzawa et al.

FOREIGN PATENT DOCUMENTS

JP 2016-012410 A 1/2016
JP 2016-118159 A 6/2016

OTHER PUBLICATIONS

European Patent Office, Extended European Search Report issued in corresponding Application No. EP 17 17 3222, dated Oct. 27, 2017.

*Primary Examiner* — Tracie Y Green
(74) *Attorney, Agent, or Firm* — Stites & Harbison, PLLC; Jeffrey A. Haeberlin; James R. Hayne

(57) ABSTRACT

In a metallic shell, cutting traces are formed on the inner circumferential surface of a trunk portion and the inner circumferential surface of an elongated leg portion. A first portion of a packing is in contact with and disposed between the rear end surface of a ledge portion of the metallic shell and the outer circumferential surface of a step portion of an insulator. A second portion of the packing is in contact with and disposed between the inner circumferential surface of a trunk portion of the metallic shell and the outer circumferential surface of a tubular portion of the insulator. A gap between the inner circumferential surface of the elongated leg portion and the outer circumferential surface of the leg portion is approximately uniform along the entire circumference.

5 Claims, 4 Drawing Sheets

SPARK PLUG CAPABLE OF RESTRAINING LATERAL SPARKING

CROSS-REFERENCE TO RELATED APPLICATIONS

The present application claims priority to Japanese Patent Application No. 2016-107857, which was filed on May 30, 2016, the disclosure of which is herein incorporated by reference in its entirety.

BACKGROUND OF THE INVENTION

Field of the Invention

The present invention relates to a spark plug, particularly, to a spark plug capable of restraining lateral sparking.

Description of Related Art

A spark plug for use in an internal combustion engine is such that a ground electrode is connected to a metallic shell attached to the outer circumference of an insulator which holds a center electrode, and faces the center electrode (e.g., Patent Document 1). Spark discharge is performed between the center electrode and the ground electrode to ignite an air-fuel mixture exposed to a gap between the two electrodes, thereby forming a flame nucleus. In recent years, in view of design, etc., of the internal combustion engine, a reduction in the diameter of a spark plug has been demanded.

RELATED ART DOCUMENT

Patent Document 1 is Japanese Patent Application Laid-Open (kokai) No. 2016-12410.

BRIEF SUMMARY OF THE INVENTION

However, since, as a result of reduction in diameter of a spark plug, the distance between the inner circumferential surface of the metallic shell and the outer circumferential surface of the insulator reduces, discharge between the metallic shell (particularly, a forward end portion thereof) and the insulator (such a discharge is hereinafter called "lateral sparking") is apt to occur, potentially resulting in misfire.

The present invention has been conceived to solve the above problem, and an object of the invention is to provide a spark plug capable of restraining lateral sparking.

To achieve the above object, according to a first aspect of an exemplary spark plug of the present invention, an insulator has a tubular portion disposed along a center axis, a leg portion smaller in outside diameter than the tubular portion, and a step portion having an outer circumferential surface which connects an outer circumferential surface of the leg portion and an outer circumferential surface of the tubular portion. A center electrode is disposed inside the insulator along the center axis. In a tubular metallic shell, a trunk portion is disposed radially outward of the tubular portion of the insulator, and a ledge portion integral with an axially forward end of the trunk portion is such that its rear end surface protruding radially inward faces the outer circumferential surface of the step portion of the insulator. An elongated leg portion integral with the ledge portion is disposed radially outward of the leg portion of the insulator. A packing is disposed between the step portion of the insulator and the ledge portion of the metallic shell. A ground electrode connected to the metallic shell faces the center electrode.

The metallic shell has cutting traces formed on an inner circumferential surface of the trunk portion and an inner circumferential surface of the elongated leg portion, respectively. A first portion of the packing is disposed between and in contact with the rear end surface of the ledge portion of the metallic shell and the outer circumferential surface of the step portion of the insulator. A second portion of the packing is disposed between and in contact with the inner circumferential surface of the trunk portion of the metallic shell and the outer circumferential surface of the tubular portion of the insulator.

In other words, according to the first aspect of an exemplary spark plug of the present invention, an insulator includes a tubular portion disposed along a center axis and having an outer circumferential surface. The insulator further includes a leg portion smaller in outside diameter than the tubular portion and having an outer circumferential surface. The insulator further includes a step portion having an outer circumferential surface which connects the outer circumferential surface of the leg portion and the outer circumferential surface of the tubular portion. A center electrode is disposed inside the insulator along the center axis. A tubular metallic shell includes a trunk portion disposed radially outward of the tubular portion of the insulator and having an axially forward end and an inner circumferential surface with cutting traces formed thereon. The tubular metallic shell further includes a ledge portion integral with and protruding radially inward of the axially forward end of the trunk portion with a rear end surface of the ledge portion facing the outer circumferential surface of the step portion of the insulator. The tubular metallic shell further includes an elongated leg portion integral with the ledge portion, disposed radially outward of the leg portion of the insulator, and having an inner circumferential surface with cutting traces formed thereon. A packing is disposed between the step portion of the insulator and the ledge portion of the metallic shell, and the packing includes a first portion disposed between, and in contact with, the rear end surface of the ledge portion of the metallic shell and the outer circumferential surface of the step portion of the insulator. The packing further includes a second portion disposed between, and in contact with, the inner circumferential surface of the trunk portion of the metallic shell and the outer circumferential surface of the tubular portion of the insulator. A ground electrode is connected to the metallic shell and facing the center electrode In assembling the metallic shell to the insulator, by means of the second portion of the packing intervening between the cut inner circumferential surface of the trunk portion of the metallic shell and the outer circumferential surface of the tubular portion of the insulator, there can be restrained eccentricity between the leg portion of the insulator and the elongated leg portion of the metallic shell whose inner circumferential surface is formed by cutting. Since the gap between the inner circumferential surface of the elongated leg portion of the metallic shell and the outer circumferential surface of the leg portion of the insulator can be rendered approximately uniform, lateral sparking can be restrained.

According to a second aspect of an exemplary spark plug of the present invention, in a section which contains the center axis, a value obtained by dividing the shorter of an axial length of the second portion of the packing as measured on the outer circumferential surface of the tubular portion of the insulator from a first imaginary straight line being orthogonal to the center axis and passing through a connection point between the outer circumferential surface of the tubular portion and the outer circumferential surface of the step portion of the insulator, and an axial length of the second portion as measured on the inner circumferential surface of the trunk portion of the metallic shell from the first imaginary straight line by a distance as measured on the first imaginary straight line between the connection point and the inner circumferential surface of the trunk portion of the metallic shell is 0.3 or greater.

In other words, according to the second aspect of an exemplary spark plug of the present invention, in a section taken along and containing the center axis, a first axial length of the second portion of the packing as measured on the outer circumferential surface of the tubular portion of the insulator is taken from a first imaginary straight line orthogonal to the center axis and passing through a connection point between the outer circumferential surface of the tubular portion and the outer circumferential surface of the step portion of the insulator, a second axial length of the second portion as measured on the inner circumferential surface of the trunk portion of the metallic shell is taken from the first imaginary straight line, and a value obtained by dividing the shorter of the first axial length and the second axial length by a distance as measured on the first imaginary straight line between the connection point and the inner circumferential surface of the trunk portion of the metallic shell is 0.3 or greater.

Since the axial length of the second portion of the packing in contact with the inner circumferential surface of the trunk portion of the metallic shell and the outer circumferential surface of the tubular portion of the insulator can be rendered long in relation to the gap between the connection point and the inner circumferential surface of the trunk portion, in assembling the metallic shell to the insulator, the center axis of the insulator to be bound to the metallic shell through the packing can become unlikely to incline. Therefore, in addition to the effect of claim 1, eccentricity between the elongated leg portion of the metallic shell and the leg portion of the insulator can be readily restrained.

According to a third aspect of an exemplary spark plug of the present invention, in the section which contains the center axis, the axial length of the second portion of the packing as measured on the outer circumferential surface of the tubular portion of the insulator from the first imaginary straight line is longer than the axial length of the second portion as measured on the inner circumferential surface of the trunk portion of the metallic shell from the first imaginary straight line.

In other words, according to the third aspect of an exemplary spark plug of the present invention, in the section taken along and containing the center axis, the first axial length is longer than the second axial length.

As compared with the case where the axial length of the second portion as measured on the outer circumferential surface of the tubular portion from the first imaginary straight line is shorter than the axial length of the second portion as measured on the inner circumferential surface of the trunk portion from the first imaginary straight line, the center axis of the insulator to be bound to the metallic shell through the packing can become more unlikely to incline; therefore, in addition to the effect of claim 2, the effect of restraining eccentricity between the elongated leg portion of the metallic shell and the leg portion of the insulator can be improved.

According to a fourth aspect of an exemplary spark plug of the present invention, in the section which contains the center axis, a value obtained by dividing an axial length of the first portion of the packing as measured on a second imaginary straight line passing through the connection point and being parallel with the center axis by the distance as measured on the first imaginary straight line between the connection point and the inner circumferential surface of the trunk portion of the metallic shell is 2.0 or less.

In other words, according to the fourth aspect of an exemplary spark plug of the present invention, in the section taken along and containing the center axis, a value obtained by dividing a third axial length of the first portion of the packing as measured on a second imaginary straight line passing through the connection point and being parallel with the center axis by the distance as measured on the first imaginary straight line between the connection point and the inner circumferential surface of the trunk portion of the metallic shell is 2.0 or less.

Since the volume of the second portion of the packing disposed between the inner circumferential surface of the trunk portion of the metallic shell and the outer circumferential surface of the tubular portion of the insulator can be secured, eccentricity of the tubular portion of the insulator in relation to the trunk portion of the metallic shell can be easily restrained. As a result, in addition to the effect of claim 2 or 3, the effect of restraining eccentricity between the leg portion of the insulator and the elongated leg portion of the metallic shell whose inner circumferential surface is formed by cutting can be improved.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

Figure 1:
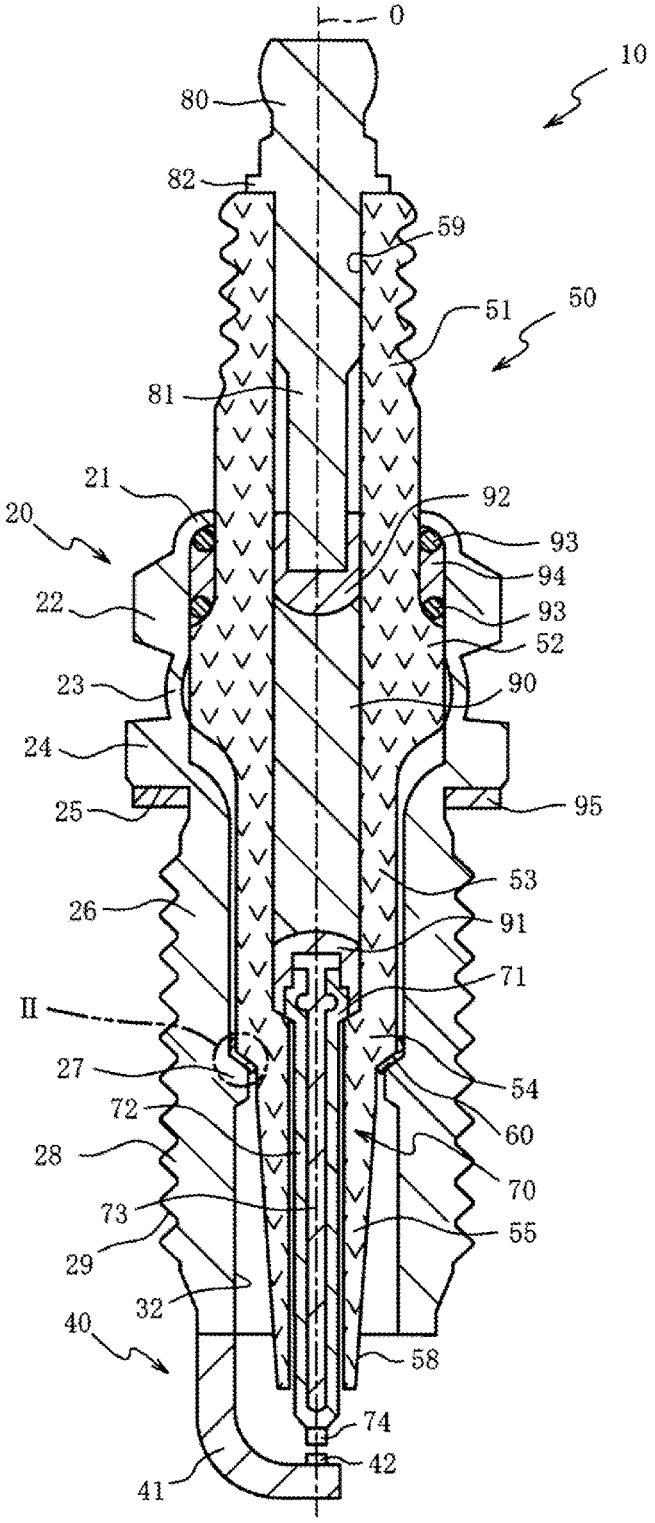
FIG. 1 is a sectional view of a spark plug according to an embodiment of the present invention.

A preferred embodiment of the present invention will next be described with reference to the appending drawings. FIG. 1 is a sectional view of a spark plug 10 according to the embodiment of the present invention, taken along a plane including a center axis O thereof. In FIG. 1, the lower side is called the forward side of the spark plug 10, and the upper side is called the rear side of the spark plug 10. As shown in FIG. 1, the spark plug 10 includes a metallic shell 20, a ground electrode 40, an insulator 50, and a center electrode 70.

The metallic shell 20 is a generally cylindrical member to be fixed to a threaded hole (not shown) of an internal combustion engine and is formed of an electrically conductive metal material (e.g., low-carbon steel). The metallic shell 20 includes, from the rear side to the forward side along the center axis O, an end portion 21, a tool engagement portion 22, a groove portion 23, a seat portion 24, a trunk portion 26, a ledge portion 27, and an elongated leg portion 29. The end portion 21 and the groove portion 23 are adapted to fix the insulator 50 by crimping. The tool engagement portion 22 is engaged with a tool such as a wrench in attaching the spark plug 10 to the internal combustion engine.

The ledge portion 27 protrudes radially inward from the trunk portion 26 and is smaller in inside diameter than the trunk portion 26. The trunk portion 26, the ledge portion 27, and the elongated leg portion 28 are located forward of the seat portion 24 and have a threaded portion 29 formed on their outer circumferential surfaces. An annular gasket 95 is fitted between the seat portion 24 and the threaded portion 29. When the threaded portion 29 is engaged with the threaded hole of the internal combustion engine, the gasket 95 is held between a seat surface 25 and the internal combustion engine (an engine head), thereby providing a seal between the metallic shell 20 and the internal combustion engine.

The ground electrode 40 includes an electrode base metal 41 (e.g., a nickel-based alloy) joined to the forward end of the metallic shell 20 (the end surface of the elongated leg portion 28) and a tip 42 joined to a distal end portion of the electrode base metal 41. The electrode base metal 41 is a rodlike member which is bent toward the center axis O so as to intersect with the center axis O. The tip 42 is formed of a noble metal, such as platinum, iridium, ruthenium, or rhodium, or an alloy which contains such a noble metal as a main component, and is joined to the electrode base metal 41 at a position where the electrode base metal 41 and the center axis O intersect with each other.

The insulator 50 is a generally cylindrical member formed of alumina or a like material having excellent mechanical characteristics and insulating performance at high temperature. The insulator 50 includes, from the rear side to the forward side along the center axis O, a rear portion 51, a protrusion 52, a tubular portion 53, a step portion 54, and a leg portion 55 and has an axial hole 59 extending therethrough along the center axis O. The insulator 50 is inserted into the metallic shell 20, and the metallic shell 20 is fixed to the outer circumference of the insulator 50. The insulator 50 is disposed such that the rear end of the rear portion 51 and the forward end of the leg portion 55 protrude from the metallic shell 20. The leg portion 55 is disposed radially inward of the elongated leg portion 28 of the metallic shell 20. An inner circumferential surface 32 of the elongated leg portion 28 of the metallic shell 20 and an outer circumferential surface 58 of the leg portion 55 of the insulator 50 face each other with a predetermined gap therebetween.

The protrusion 52 protrudes radially outward of the rear portion 51 and is disposed radially inward of the groove portion 23 of the metallic shell 20. The tubular portion 53 and the leg portion 55 are disposed radially inward of the trunk portion 26 and the elongated leg portion 28, respectively, of the metallic shell 20. The step portion 54 located between the tubular portion 53 and the leg portion 55 has an inner circumferential surface and an outer circumferential surface 57 (see FIG. 2) whose diameters reduce toward the forward side.

The packing 60 is an annular plate member formed of a soft steel plate or a like metal material softer than a metal material used to form the metallic shell 20. The packing 60 is subjected to carburizing or carbonitriding as needed. When the end portion 21 of the metallic shell 20 is crimped radially inward toward the insulator 50, the insulator 50 is pressed toward the ledge portion 27 of the metallic shell 20 through two ring members 93 disposed along the outer circumference of the rear portion 51 of the insulator 50 and through a filler 94 such as talc held between the ring members 93. As a result, the packing 60 held between the ledge portion 27 of the metallic shell 20 and the step portion 54 of the insulator 50 plastically deforms. The packing 60 airtightly closes the gap between the ledge portion 27 and the step portion 54.

The center electrode 70 is a rodlike electrode configured such that a closed-bottomed tubular electrode base metal has a core 73 being higher in thermal conductivity than the electrode base metal and embedded therein. The core 73 is formed of copper or an alloy which contains copper as a main component. The center electrode 70 includes a head portion 71 disposed on the step portion 54 of the insulator 50, and a shaft portion 72 extending forward along the center axis O.

The forward end of the shaft portion 72 protrudes from the axial hole 59 of the insulator 50, and a tip 74 is joined to the forward end. The tip 74 is a columnar member formed of a noble metal, such as platinum, iridium, ruthenium, or rhodium, or an alloy which contains such a noble metal as a main component. The tip 74 faces the tip 42 of the ground electrode 40 through a spark gap.

A metal terminal member 80 is a rodlike member to which a high-voltage cable (not shown) is connected, and is formed of an electrically conductive metal material (e.g., low-carbon steel). A forward portion of the metal terminal member 80 is disposed in the axial hole 59 of the insulator 50.

The resistor 90 is a member for suppressing radio noise generated as a result of sparking and is disposed in the axial hole 59 of the insulator 50 between the metal terminal member 80 and the center electrode 70. Electrically conductive glass seals 91 and 92 are disposed between the resistor 90 and the center electrode 70 and between the resistor 90 and the metal terminal member 80, respectively. The glass seal 91 is in contact with the resistor 90 and with the center electrode 70, and the glass seal 92 is in contact with the resistor 90 and with the metal terminal member 80. As a result, the center electrode 70 and the metal terminal member 80 are electrically connected through the resistor 90 and the glass seals 91 and 92.

The spark plug 10 is manufactured by the following method, for example. First, the center electrode 70 is inserted into the axial hole 59 of the insulator 50 from the rear portion 51 side of the insulator 50. The center electrode 70 is such that the tip 74 is joined to the forward end of the shaft portion 72. The center electrode 70 is supported at the head portion 71 by the step portion 54 of the insulator 50, whereby a forward end portion thereof protrudes from the forward end of the axial hole 59.

Next, material powder of the glass seal 91 is charged into the axial hole 59 in a region around and rearward of the head portion 71 of the center electrode 70. By use of a compaction rod (not shown), the material powder of the glass seal 91 charged into the axial hole 59 is preliminarily compacted. Material powder of the resistor 90 is charged onto the material powder compact of the glass seal 91. By use of the compaction rod (not shown), material powder of the resistor 90 charged into the axial hole 59 is preliminarily compacted. Next, material powder of the glass seal 92 is charged onto the material powder compact of the resistor 90. By use of the compaction rod (not shown), the material powder of the glass seal 92 charged into the axial hole 59 is preliminarily compacted.

Subsequently, a forward end portion 81 of the metal terminal member 80 is inserted into the axial hole 59 from the rear end of the axial hole 59 so as to come into contact with the material powder compact of the glass seal 92. Next, while heat is applied to a temperature higher than softening points of glass components contained in the material powders, the metal terminal member 80 is pressed further into the axial hole 59 until the forward end surface of a flange portion 82 provided near the rear end of the metal terminal member 80 comes into contact with the rear end surface of the insulator 50, so that the forward end portion 81 applies an axial load to the material powder compacts of the glass seals 91 and 92 and the resistor 90. As a result, the material powder compacts are further compacted and sintered, thereby forming the glass seals 91 and 92 and the resistor 90 within the insulator 50.

Next, the metallic shell 20 to which the ground electrode 40 is joined beforehand is assembled to the outer circumference of the insulator 50. Subsequently, the tip 42 is joined to the electrode base metal 41 of the ground electrode 40; then, the electrode base metal 41 is bent so that the tip 42 of the ground electrode 40 axially faces the tip 74 of the center electrode 70, thereby yielding the spark plug 10.

Figure 3:
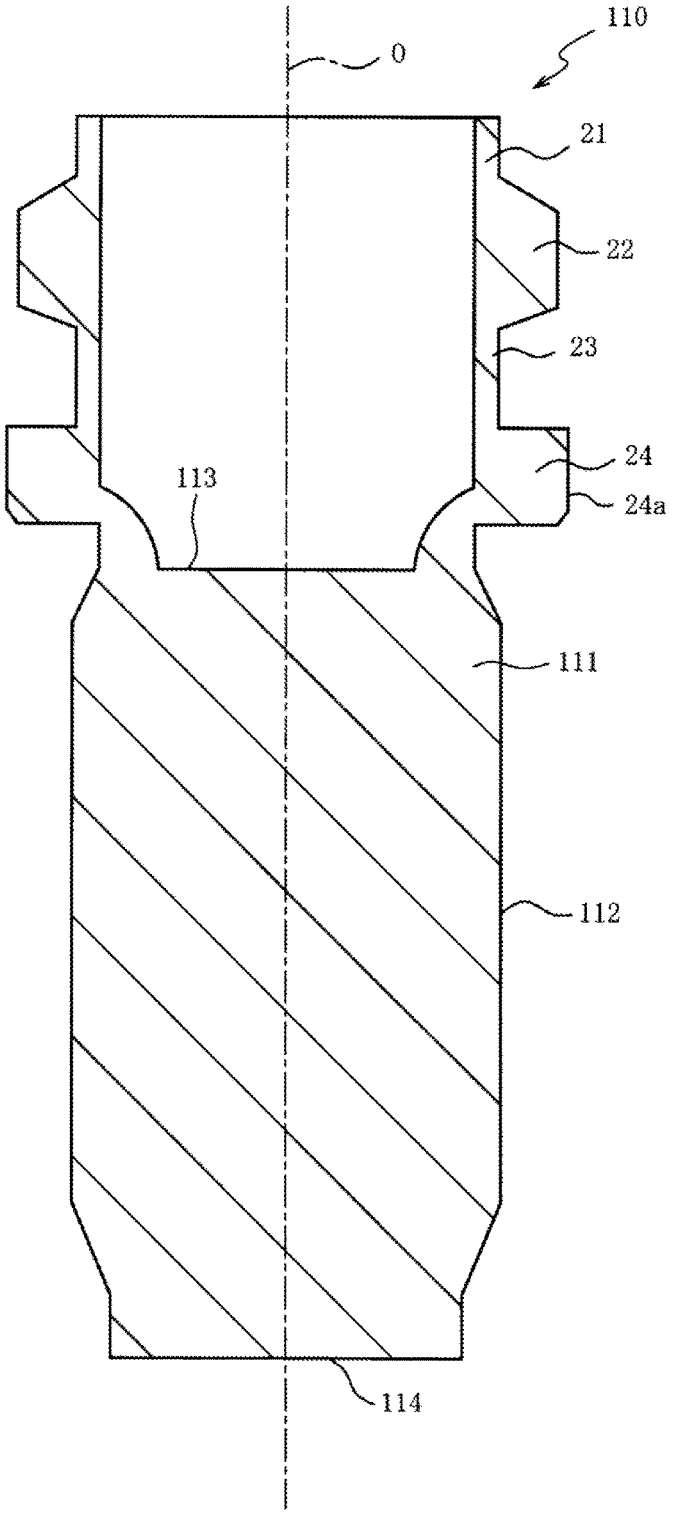
FIG. 3 is a sectional view of an intermediate of a metallic shell.
Figure 4:
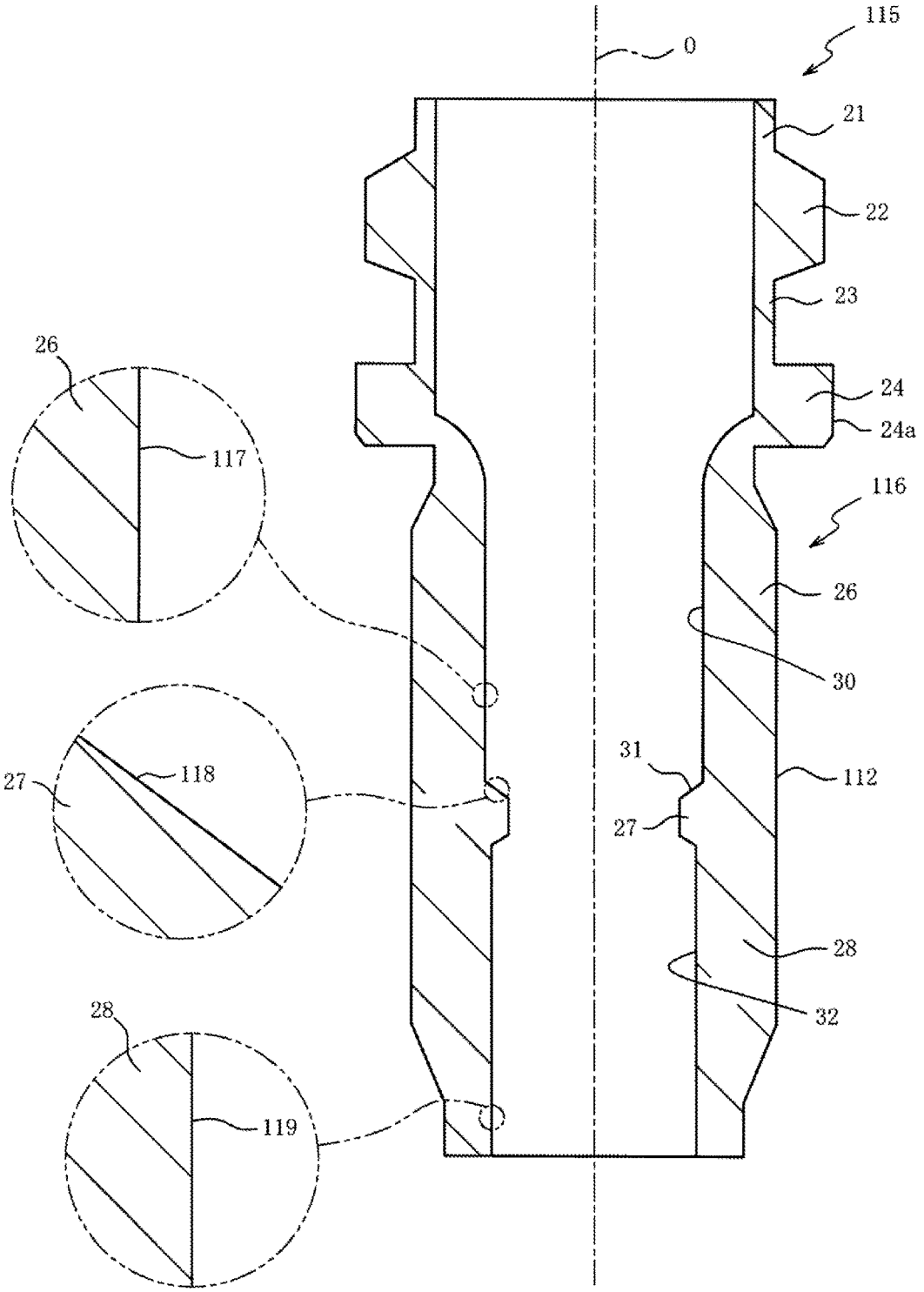
FIG. 4 is a sectional view of an intermediate of the metallic shell.

With reference to FIGS. 3 and 4, an example method of manufacturing the metallic shell 20 to be assembled to the outer circumference of the insulator 50 will be described. FIG. 3 is a sectional view of an intermediate 110 of the metallic shell 20 taken to include the center axis O, and FIG. 4 is a sectional view of an intermediate 115 of the metallic shell 20 taken to include the center axis O. The intermediate 110 is a generally circular columnar member formed by performing cold forging or the like on a metal material such as low-carbon steel or stainless steel.

As shown in FIG. 3, the intermediate 110 has a circular columnar portion 111 in which the trunk portion 26, the ledge portion 27, and the elongated leg portion 28 are not yet formed. The metallic shell 20 is manufactured by cutting the intermediate 110. First, the intermediate 110 is chucked at an outer circumferential surface 112 of the circular columnar portion 111 in such a manner that, in a section orthogonal to the center axis O, the center axis O becomes the center of a circle formed by an outer circumferential surface 24*a* of the seat portion 24; then, the outer circumferential surface 24*a* of the seat portion 24 is subjected to cutting by a lathe, for example.

Next, as shown in FIG. 4, while the intermediate 110 (see FIG. 3) is chucked at the outer circumferential surface 112 of the circular columnar portion 111 in such a manner that, in a section orthogonal to the center axis O, the center axis O becomes the centers of circles formed by an inner circumferential surface 30 of the trunk portion 26 and a rear end surface 31 of the ledge portion 27, respectively; and a drill (not shown) is applied to an axial first end surface 113 of the circular columnar portion 111, followed by drilling a hole.

Further, the intermediate 110 (see FIG. 3) is chucked at the outer circumferential surface 24*a* of the seat portion 24 in such a manner that, in a section orthogonal to the center axis O, the center axis O becomes the center of a circle formed by the inner circumferential surface 32 of the elongated leg portion 28; then, a drill (not shown) is applied to an axial second end surface 114 of the circular columnar portion 111, followed by drilling a hole.

As a result, the inner circumferential surface 30 of the trunk portion 26, the rear end surface 31 of the ledge portion 27, and the inner circumferential surface 32 of the elongated leg portion 28 are formed by cutting (see FIG. 4). In a section orthogonal to the center axis O, circles formed by the inner circumferential surface 30 of the trunk portion 26, the rear end surface 31 of the ledge portion 27, and the inner circumferential surface 32 of the elongated leg portion 28 become concentric circles. This working yields the intermediate 115 having a cylindrical portion 116 in which, as a result of drilling, cutting traces 117, 118, and 119 are formed on the inner circumferential surface 30 of the trunk portion 26, the rear end surface 31 of the ledge portion 27, and the inner circumferential surface 32 of the elongated leg portion 28, respectively.

Next, the electrode base metal 41 of the ground electrode 40 is joined to the forward end surface of the cylindrical portion 116 of the intermediate 115 by resistance welding, for example. Then, the threaded portion 29 (see FIG. 1) is formed on the outer circumferential surface 112 of the cylindrical portion 116 by rolling, for example, thereby yielding the metallic shell 20. Subsequently, the metallic shell 20 is subjected to surface treatment such as zinc plating or nickel plating.

Next, the packing 60 (an annular member before plastic deformation) is disposed on the rear end surface 31 of the ledge portion 27 of the metallic shell 20; subsequently, the insulator 50 is axially inserted into the metallic shell 20 from the end portion 21 of the metallic shell 20. The ring members 93 and the filler 94 are inserted between the end portion 21 of the metallic shell 20 and the insulator 50; then, the end portion 21 is axially pressed by use of a jig (not shown) having a cavity corresponding to the shape of crimping of the end portion 21, thereby bending the end portion 21 radially inward.

By this procedure, the metallic shell 20 and the insulator 50 are fixed together. The groove portion 23 buckles under load applied to the metallic shell 20 to undergo bending deformation. As a result, the end portion 21 of the metallic shell 20 presses the protrusion 52 of the insulator 50 axially forward through the ring members 93 and the filler 94. Accordingly, the packing 60 is held between the step portion 54 of the insulator 50 and the ledge portion 27 of the metallic shell 20. As a result, the packing 60 is plastically deformed, whereby the packing 60 comes into close contact with the step portion 54 of the insulator 50 and the ledge portion 27 of the metallic shell 20.

Figure 2:
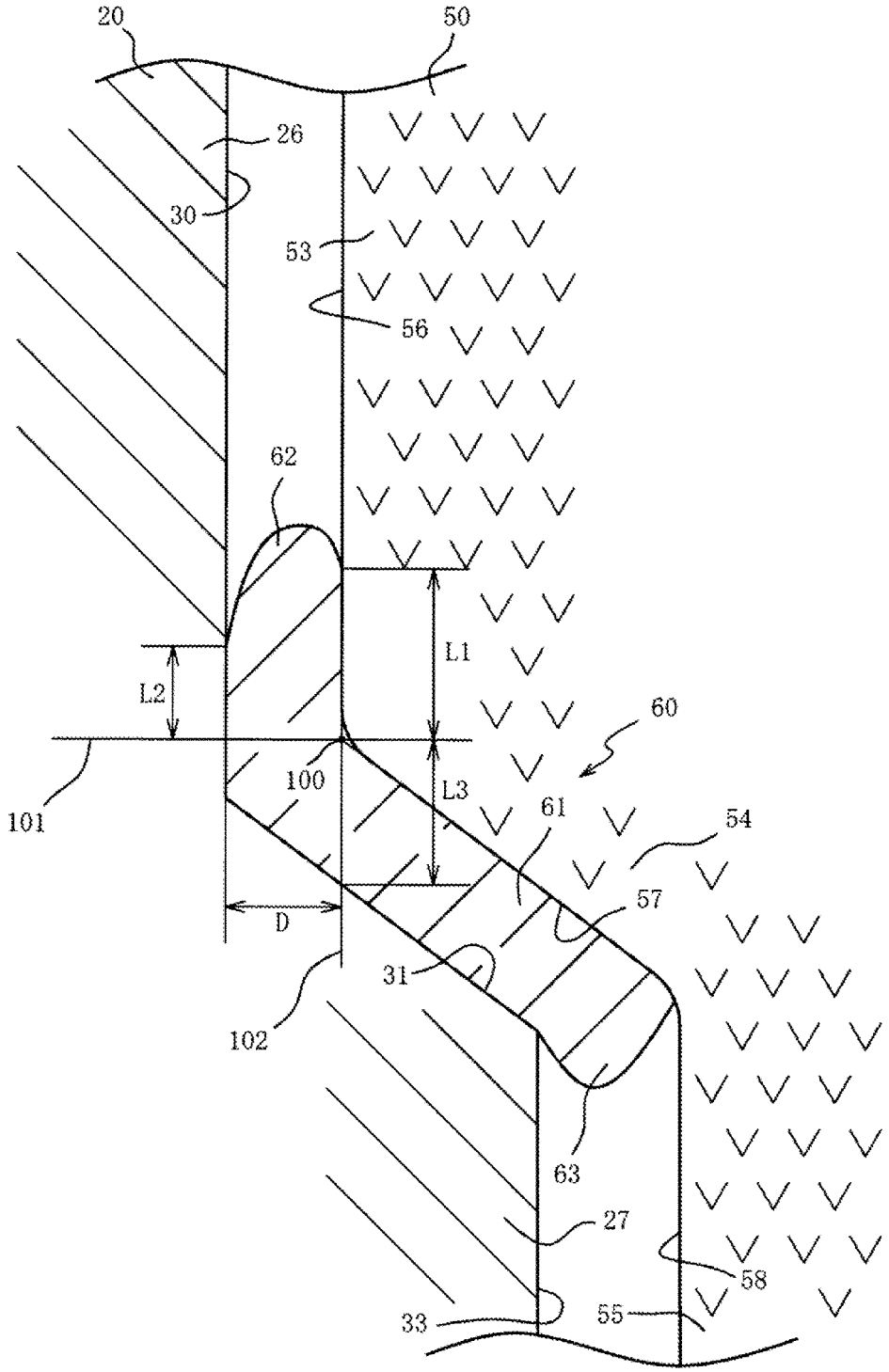
FIG. 2 is a sectional view of the spark plug showing, on an enlarged scale, region II of FIG. 1.

With reference to FIG. 2, the packing 60 will be described. FIG. 2 is a sectional view of the spark plug 10 which contains the center axis O, showing, on an enlarged scale, region II of FIG. 1. In the metallic shell 20, the inner circumferential surface 30 of the trunk portion 26 and the rear end surface 31 of the ledge portion 27 are connected, and the rear end surface 31 of the ledge portion 27 and the inner circumferential surface 33 of the ledge portion 27 are connected. The rear end surface 31 of the ledge portion 27 reduces in diameter toward the forward side of the metallic shell 20 (the lower side in FIG. 2). In the insulator 50, the outer circumferential surface 57 of the step portion 54 is connected to the outer circumferential surface 56 of the tubular portion 53, and the outer circumferential surface 58 of the leg portion 55 is connected to the outer circumferential surface 57. The outer circumferential surface 57 of the step portion 54 reduces in diameter toward the forward side of the insulator 50 (the lower side in FIG. 2).

The packing 60 includes a first portion 61 disposed between and in contact with the rear end surface 31 of the ledge portion 27 of the metallic shell 20 and the outer circumferential surface 57 of the step portion 54 of the insulator 50, and a second portion 62 disposed between and in contact with the inner circumferential surface 30 of the trunk portion 26 of the metallic shell 20 and the outer circumferential surface 56 of the tubular portion 53 of the insulator 50. The second portion 62 arises as a result of plastic deformation of the packing 60 in assembling the metallic shell 20 to the insulator 50, and the first portion 61 and the second portion 62 are integral with each other.

In the present embodiment, the packing 60 includes a third portion 63 disposed between the inner circumferential surface 33 of the ledge portion 27 of the metallic shell 20 and the outer circumferential surface 58 of the leg portion 55 of the insulator 50. The third portion 63 arises as a result of plastic deformation of the packing 60 in assembling the metallic shell 20 to the insulator 50, and the first portion 61 and the third portion 63 are integral with each other. Notably, the third portion 63 is not necessarily required.

The second portion 62 of the packing 60 is formed as follows: in assembling the metallic shell 20 to the insulator 50, the packing 60 is held between the step portion 54 of the insulator 50 and the ledge portion 27 of the metallic shell 20; as a result, the packing 60 partially enters between the outer circumferential surface 56 of the tubular portion 53 of the insulator 50 and the inner circumferential surface 30 of the trunk portion 26 on which the cutting trace 117 (see FIG. 4) is formed. By virtue of the second portion 62 intervening between the inner circumferential surface 30 of the trunk portion 26 and the outer circumferential surface 56 of the tubular portion 53, when the step portion 54 of the insulator 50 is pressed toward the ledge portion 27 of the metallic shell 20, the tubular portion 53 of the insulator 50 is unlikely to become eccentric in relation to the trunk portion 26 of the metallic shell 20.

Since, in the metallic shell 20, the inner circumferential surface 30 of the trunk portion 26 and the inner circumferential surface 32 of the elongated leg portion 28 are in such a relation that their sections orthogonal to the center axis O (see FIG. 1) form concentric circles having the center axis O as a common center, if eccentricity between the trunk portion 26 of the metallic shell 20 and the tubular portion 53 of the insulator 50 can be restrained by means of the second portion 62 of the packing 60, eccentricity between the elongated leg portion 28 of the metallic shell 20 and the leg portion 55 of the insulator 50 can be restrained. Since, in assembling the metallic shell 20 to the insulator 50, the gap between the inner circumferential surface 32 of the elongated leg portion 28 of the metallic shell 20 and the outer circumferential surface 58 of the leg portion 55 of the insulator 50 can be rendered approximately uniform along the entire circumference, even in the case of a small-diameter spark plug 10 whose threaded portion 29 has a nominal size of, for example, 10 mm or less, lateral sparking can be restrained. This is because lateral sparking is likely to occur across a narrowed gap between the inner circumferential surface 32 of the elongated leg portion 28 and the outer circumferential surface 58 of the leg portion 55.

Since at least a portion of the inner circumferential surface 30 of the trunk portion 26 located near the rear end surface 31 of the ledge portion 27 (a forward portion of the inner circumferential surface 30 of the trunk portion 26) and at least a forward portion of the inner circumferential surface 32 of the elongated leg portion 28 are in a concentric relation, the gap between the inner circumferential surface 32 of at least a forward portion of the elongated leg portion 28 of the metallic shell 20 and the outer circumferential surface 58 of the leg portion 55 of the insulator 50 can be rendered approximately uniform along the entire circumference by means of the second portion 62 of the packing 60. As a result, there can be restrained lateral sparking which could otherwise occur between the inner circumferential surface 32 of a forward portion of the elongated leg portion 28 and the outer circumferential surface 58 of the leg portion 55.

A first imaginary straight line 101 passes through a connection point 100 between the outer circumferential surface 56 of the tubular portion 53 and the outer circumferential surface 57 of the step portion 54 of the insulator 50 and is orthogonal to the center axis O (see FIG. 1). A second imaginary straight line 102 passes through the connection point 100 and is parallel with the center axis O. The connection point 100 indicates the boundary between the outer circumferential surface 56 of the tubular portion 53 and the outer circumferential surface 57 of the step portion 54.

In the present embodiment, since the boundary between the outer circumferential surface 56 of the tubular portion 53 and the outer circumferential surface 57 of the step portion 54 is radiused, the connection point 100 is a point of intersection of a straight extension line extending along the center axis O of the outer circumferential surface 56 of the tubular portion 53 and a straight extension line extending radially outward of the outer circumferential surface 57 of the step portion 54. Similarly, in the case where the boundary is chamfered, the connection point 100 is a point of intersection of a straight extension line extending along the center axis O of the outer circumferential surface 56 of the tubular portion 53 and a straight extension line extending radially outward of the outer circumferential surface 57 of the step portion 54. Notably, in the case where the boundary between the outer circumferential surface 56 of the tubular portion 53 and the outer circumferential surface 57 of the step portion 54 is angular (the boundary is not radiused or chamfered), the connection point 100 is a point of intersection of the outer circumferential surface 56 of the tubular portion 53 and the outer circumferential surface 57 of the step portion 54.

Since the second portion 62 of the packing 60 is in contact with the outer circumferential surface 56 of the tubular portion 53 of the insulator 50 and with the inner circumferential surface 30 of the trunk portion 26 of the metallic shell 20, an axial length L1 of the second portion 62 as measured on the outer circumferential surface 56 of the tubular portion 53 from the first imaginary straight line 101, and an axial length L2 of the second portion 62 as measured on the inner circumferential surface 30 of the trunk portion 26 from the first imaginary straight line 101 can be obtained. In the present embodiment, L1 is longer than L2 (L1>L2). The second portion 62 is such that a value (in the present embodiment, L2/D) obtained by dividing L1 or L2, whichever is shorter (in the present embodiment, L2), by a distance D as measured on the first imaginary straight line 101 between the connection point 100 and the inner circumferential surface 30 of the trunk portion 26 of the metallic shell 20 is 0.3 or greater.

Because of L2/D≥0.3, the amount of entry of the second portion 62 of the packing 60 between the trunk portion 26 of the metallic shell 20 and the tubular portion 53 of the insulator 50 is large, whereby in assembling the metallic shell 20 to the insulator 50, there can be secured the function of the second portion 62 of binding the tubular portion 53 of the insulator 50 to the trunk portion 26 of the metallic shell 20. As a result, eccentricity between the trunk portion 26 and the tubular portion 53 can be more effectively restrained. Since the inner circumferential surface 30 of the trunk portion 26 and the inner circumferential surface 32 of the elongated leg portion 28 are concentrically cut, by means of restraining eccentricity between the trunk portion 26 and the tubular portion 53, eccentricity between the elongated leg portion 28 of the metallic shell 20 and the leg portion 55 of the insulator 50 can be restrained. As a result, lateral sparking can be restrained.

Notably, the distance D is set to the range "0.05≤D≤0.25 (mm)." This is for allowing the second portion 62 of the packing 60 to enter between the trunk portion 26 of the metallic shell 20 and the tubular portion 53 of the insulator 50 so as to secure the function of the second portion 62 of binding the tubular portion 53 of the insulator 50. In the case of D<0.05 mm, the second portion 62 of the packing 60 is unlikely to enter between the trunk portion 26 and the tubular portion 53 (the second portion 62 is unlikely to be formed). In the case of D>0.25 mm, since the tubular portion 53 is distant from the trunk portion 26 having the cutting trace 117 formed on the inner circumferential surface 30, the second portion 62 intervening between the trunk portion 26 and the tubular portion 53 suffers deterioration of its function of binding the tubular portion 53 of the insulator 50.

Since the lengths L1 and L2 of the second portion 62 of the packing 60 are set to satisfy the relation of L1>L2, as compared with the case where the lengths L1 and L2 are set to satisfy the relation of L1≤L2, it is possible to improve the function of the metallic shell 20 binding the insulator 50 through the packing 60 to thereby prevent the center axis O (see FIG. 1) of the insulator 50 from inclining. Since, through impartment of a feature of L1>L2 to the second portion 62, the length of the second portion 62 in contact with the insulator 50 increases, the inclination of the center axis O of the insulator 50 in relation to the center axis O of the metallic shell 20 can be readily restricted. As a result, since the gap between the inner circumferential surface 32 of the elongated leg portion 28 of the metallic shell 20 and the outer circumferential surface 58 of the leg portion 55 of the insulator 50 can be rendered approximately uniform along the entire circumference, lateral sparking can be restrained. Further, since, as compared with the case of L1 L2, the load applied by the second portion 62 to the tubular portion 53 of the insulator 50 can be dispersed, the tubular portion 53 becomes unlikely to be damaged.

The packing 60 is designed such that a value (L3/D) obtained by dividing an axial length L3 of the first portion 61 on the second imaginary straight line 102 by the distance D is 2.0 or less. Since the axial length L3 of the first portion 61 is set to satisfy the relation of L3/D≤2.0, an axial distance of the second portion 62 can be secured in relation to the axial length of the first portion 61, the volume of the second portion 62 disposed between the inner circumferential surface 30 of the trunk portion 26 of the metallic shell 20 and the outer circumferential surface 56 of the tubular portion 53 of the insulator 50 can be secured. Since a sufficient volume of the second portion 62 can be secured, eccentricity of the tubular portion 53 of the insulator 50 in relation to the trunk portion 26 of the metallic shell 20 can be readily restrained. Since, in the metallic shell 20, the inner circumferential surface 30 of the trunk portion 26 and the inner circumferential surface 32 of the elongated leg portion 28 are concentrically cut, by means of restraining eccentricity between the trunk portion 26 and the tubular portion 53, eccentricity of the leg portion 55 of the insulator 50 in relation to the elongated leg portion 28 of the metallic shell 20 can be restrained.

By contrast, in the case of L3/D>2.0, since the volume of the second portion 62 of the packing 60 becomes relatively small, the function of the second portion 62 of binding the tubular portion 53 of the insulator 50 to the trunk portion 26 of the metallic shell 20 deteriorates. Notably, L1, L2, L3, and D are determined according to the size of a gap between the insulator 50 and the metallic shell 20, the inclinations of the rear end surface 31 of the metallic shell 20 and the outer circumferential surface 57 of the insulator 50 in relation to the center axis O, the thickness and shape of the packing 60, an axial load of the insulator 50, etc.

In the metallic shell 20, not only are the cutting traces 117 and 119 formed on the inner circumferential surface 30 of the trunk portion 26 and the inner circumferential surface 32 of the elongated leg portion 28, respectively, but also the cutting trace 118 is formed on the rear end surface 31 of the ledge portion 27. Thus, accurate control can be carried out on the volume and lengths (L1, L2) of the second portion 62 of the packing 60 formed as a result of the packing 60 being held between the rear end surface 31 of the ledge portion 27 of the metallic shell 20 and the outer circumferential surface 57 of the step portion 54 of the insulator 50, the axial length L3 of the first portion 61 of the packing 60, etc. As a result, the function of the second portion 62 of restraining eccentricity between the metallic shell 20 and the insulator 50 can be improved. Notably, the cutting trace 118 of the rear end surface 31 of the ledge portion 27 is not necessarily required. This is for the following reason: since the rear end surface 31 of the ledge portion 27 is inclined in relation to the center axis O, the ledge portion 27 is inferior to the trunk portion 26 in the function of binding the insulator 50 through the packing 60.

EXAMPLES

The present invention will be described further in detail, by way of example; however, the present invention is not limited thereto.

Experimental Examples 1 to 11.

Experimental examples 1to 11 examined the spark plugs 10 manufactured by assembling the insulators 50 of the same size to the metallic shells 20 of the same size, respectively. The spark plugs 10 were measured for the amount of offset (hereinafter called the "eccentricity") between the center of a circle formed by the inner circumferential surface 32 of the elongated leg portion 28 of the metallic shell 20 and the center of a circle formed by the outer circumferential surface 58 of the leg portion 55 of the insulator 50 and for the value of L2/D. Since the smaller the eccentricity, the higher the degree of uniformity of a gap, along the entire circumference, between the inner circumferential surface 32 of the elongated leg portion 28 and the outer circumferential surface 58 of the leg portion 55, lateral sparking caused by eccentricity can be restrained to a higher degree.

The metallic shells 20 used in experimental examples 3 to 11 were each formed as follows: the intermediate 110 (see FIG. 3) was formed by cold forging or the like; then, the inner circumferential surface 30 of the trunk portion 26, the rear end surface 31 of the ledge portion 27, and the inner circumferential surface 32 of the elongated leg portion 28 were formed by cutting such that the cross sections of the inner circumferential surface 30, the rear end surface 31, and the inner circumferential surface 32 assumed the form of concentric circles. For comparison purposes, the cutting work was not employed in forming the metallic shells 20 of experimental examples 1 and 2.

The eccentricity was measured by use of a three-dimensional measuring machine. The spark plug 10 was fixed to the three-dimensional measuring machine; a probe of the three-dimensional measuring machine was brought into contact with the forward end of the inner circumferential surface 32 of the elongated leg portion 28 of the metallic shell 20 at predetermined measurement points so as to detect the coordinates of the circle of the inner circumferential surface 32; and from the detected coordinates, the coordinates A of the center of the inner circumferential surface 32 were calculated. Next, the probe was brought into contact with the outer circumferential surface 58 of the leg portion 55 of the insulator 50 at positions corresponding to the measurement points so as to detect the coordinates of the circle of the outer circumferential surface 58, and from the detected coordinates, the coordinates B of the center of the outer circumferential surface 58 were calculated. The eccentricity is a distance between the coordinates A and the coordinates B.

In experimental examples 1 to 11, the value of L2/D was varied by means of varying load to be applied to the insulator 50 in assembling the insulator 50 to the metallic shell 20. L2 and D were measured through nondestructive observation of a section which contained the center axis O (a section at a position where the maximum eccentricity was observed), by use of a radioscopic apparatus. Since, in a section which contains the center axis O, the packing 60 appears on opposite sides with respect to the center axis O, L2 and D were measured on the opposite sides of the center axis O, and the average of the measured values of L2 and the average of the measured values of D were calculated for use as L2 and D, respectively. As a result of the nondestructive observation, the spark plugs of experimental examples 1 to 11 exhibited the relation "L1>L2."

Table 1 shows whether or not the metallic shell 20 underwent cutting, the value of L2/D, and judgment on eccentricity. Criteria for the spark plugs 10 were as follows: the spark plug 10 having an eccentricity of 0.06 mm or less was judged A (acceptance); the spark plug 10 having an eccentricity falling in the range "0.06 mm<eccentricity≤0.09 mm" was judged B (acceptance); the spark plug 10 having an eccentricity falling in the range "0.09 mm<eccentricity≤0.12 mm" was judged C (acceptance); the spark plug 10 having an eccentricity falling in the range "0.12 mm<eccentricity≤0.15 mm" was judged D (acceptance); and the spark plug 10 having an eccentricity in excess of 0.15 mm was judged NG (rejection).

TABLE 1

| | Cutting work on metallic shell | | | | |
|---|---|---|---|---|---|
| | Trunk portion | Ledge portion | Elongated leg portion | L2/D | Judgment |
| Experimental example 1 | Not performed | Not performed | Not performed | 1.00 | NG |
| Experimental example 2 | Not performed | Not performed | Performed | 0.92 | NG |
| Experimental example 3 | Performed | Performed | Performed | 1.00 | B |
| Experimental example 4 | Performed | Performed | Performed | 0.46 | C |
| Experimental example 5 | Performed | Performed | Performed | 0.38 | C |
| Experimental example 6 | Performed | Performed | Performed | 0.30 | C |
| Experimental example 7 | Performed | Performed | Performed | 0.23 | D |
| Experimental example 8 | Performed | Performed | Performed | 0.15 | D |
| Experimental example 9 | Performed | Performed | Performed | 0.08 | D |
| Experimental example 10 | Performed | Performed | Performed | 0.00 | NG |
| Experimental example 11 | Performed | Performed | Performed | −0.08 | NG |

As shown in Table 1, in experimental examples 3 to 11, the spark plugs 10 of experimental examples 3 to 9 had an L2/D value falling in the range "L2/D>0" (the second portion 62 of the packing 60 exists) and were judged B, C, or D (acceptance). The spark plugs 10 of experimental examples 3 to 6 having an L2/D value falling in the range "L2/D≥0.3" were smaller in eccentricity than the spark plugs of experimental examples 7 to 9 having an L2/D value falling in the range "0<L2/D<0.3." Further, the spark plug 10 of experimental example 3 greater in the L2/D value than the spark plugs 10 of experimental examples 4 to 6 was smaller in eccentricity than those of experimental examples 4 to 6.

By contrast, the spark plugs 10 of experimental examples 10 and 11 having an L2/D value falling in the range "L2/D≤0" were judged NG. Notably, the reason why the spark plug 10 of experimental example 11 has a minus L2/D value is that the inner circumferential surface 30 of the trunk portion 26 and the second portion 62 of the packing 60 are not in contact with each other in a region above the first imaginary straight line 101 in FIG. 2 (i.e., the second portion 62 does not exist). This indicates that forming the second portion 62 through plastic deformation of the packing 60, as well as satisfaction of the condition "L2/D>0," is effective for restraining eccentricity. Further, satisfaction of the condition "L2/D≥0.3" is more effective for restraining eccentricity.

In spite of having an L2/D value falling in the range "L2/D 0.3," judgment "NG" was made on the spark plug 10 of experimental example 1 using the metallic shell 20 whose trunk portion 26, ledge portion 27, and elongated leg portion 28 did not undergo cutting, and on the spark plug 10 of experimental example 2 using the metallic shell 20 whose trunk portion 26 and ledge portion 27 did not undergo cutting and whose elongated leg portion 28 underwent cutting. This indicates that forming both the trunk portion 26 and the elongated leg portion 28 of the metallic shell 20 by cutting, as well as forming the second portion 62 of the packing 60, is effective for restraining eccentricity.

Experimental Examples 12 to 20.

Experimental examples 12 to 20 examined the spark plugs 10 manufactured by assembling the insulators 50 of the same size to the metallic shells 20 of the same size, respectively. The spark plugs 10 were measured for eccentricity, and L3/D and L2/D. The metallic shells 20 used in experimental examples 12 to 20 were each formed as follows: the intermediate 110 (see FIG. 3) was formed by cold forging or the like; then, the inner circumferential surface 30 of the trunk portion 26, the rear end surface 31 of the ledge portion 27, and the inner circumferential surface 32 of the elongated leg portion 28 were formed by cutting such that the cross sections of the inner circumferential surface 30, the rear end surface 31, and the inner circumferential surface 32 assumed the form of concentric circles. Eccentricity was measured similarly to the case of measurement of eccentricity in experimental examples 1 to 11.

In experimental examples 12 to 20, the values of L3/D and L2/D were varied by means of varying load to be applied to the insulator 50 in assembling the insulator 50 to the metallic shell 20. L3 was measured similarly to the case of measurement of L2 and D. Notably, L1 and L2 in the spark plugs 10 of experimental examples 12 to 20 exhibited the relation "L1>L2."

Table 2 shows whether or not the metallic shell 20 underwent cutting, the values of L3/D and L2/D, and judgment on eccentricity. Criteria for eccentricity are similar to those of experimental examples 1 to 11.

TABLE 2

| | Cutting work on metallic shell | | | | | |
|---|---|---|---|---|---|---|
| | Trunk portion | Ledge portion | Elongated leg portion | L3/D | L2/D | Judgment |
| Experimental example 12 | Performed | Performed | Performed | 0.69 | 1.92 | A |
| Experimental example 13 | Performed | Performed | Performed | 1.00 | 1.00 | B |
| Experimental example 14 | Performed | Performed | Performed | 1.38 | 0.46 | C |
| Experimental example 15 | Performed | Performed | Performed | 1.54 | 0.38 | C |
| Experimental example 16 | Performed | Performed | Performed | 1.77 | 0.30 | C |
| Experimental example 17 | Performed | Performed | Performed | 1.92 | 0.23 | D |
| Experimental example 18 | Performed | Performed | Performed | 2.00 | 0.15 | D |
| Experimental example 19 | Performed | Performed | Performed | 2.23 | 0.00 | NG |
| Experimental example 20 | Performed | Performed | Performed | 2.31 | −0.62 | NG |

As shown in Table 2, the spark plugs 10 of experimental examples 12 to 18 satisfy the conditions "L3/D 2.0" and "L2/D>0." The spark plugs 10 of experimental examples 12 to 18 satisfying the conditions were judged A to D (acceptance) and showed a tendency to reduce in eccentricity as the L3/D value reduces. The tendency depends on the L2/D value, though. By contrast, the spark plugs 10 of experimental examples 19 and 20, which satisfy the conditions "L3/D>2.0" and "L2/D≤0," were judged NG (rejection). This indicates that satisfaction of the condition "L3/D≤2.0" is effective for restraining eccentricity.

While the present invention has been described with reference to the above embodiment, the present invention is not limited thereto, but may be embodied through various improvements or modifications without departing from the spirit and scope of the invention. For example, the above-mentioned shapes of the ground electrode 40 and the packing 60 are mere examples and can be determined as appropriate. Similarly, the above-mentioned shapes, sizes, etc., of the metallic shell 20 and the insulator 50 are mere examples and can be determined as appropriate.

The above embodiment has been described while referring to the ground electrode 40 and the center electrode 70 having the tips 42 and 74, respectively, but the invention is not limited thereto. Needless to say, the tips 42 and 74 can be eliminated.

The above embodiment has been described while referring to the spark plug 10 having the resistor 90 incorporated therein, but the invention is not limited thereto. Needless to say, the resistor 90 can be eliminated. In this case, the metal terminal member 80 and the center electrode 70 are joined by the glass seal 91.

The above embodiment has been described while referring to the case where the end portion 21 of the metallic shell 20 crimps the insulator 50 through the ring members 93 and the filler 94, but the present invention is not limited thereto. Needless to say, the end portion 21 of the metallic shell 20 can be crimped to the protrusion 52 of the insulator 50 with the ring members 93 and the filler 94 being eliminated.

DESCRIPTION OF REFERENCE NUMERALS

10: spark plug
20: metallic shell
26: trunk portion
27: ledge portion
28: elongated leg portion
30, 32: inner circumferential surface
31: rear end surface
40: ground electrode
50: insulator
53: tubular portion
54: step portion
55: leg portion
56, 57, 58: outer circumferential surface
60: packing
61: first portion
62: second portion
70: center electrode
100: connection point
101: first imaginary straight line
102: second imaginary straight line
117, 119: cutting trace
D: distance
L1, L2, L3: length
O: center axis

What is claimed is:

1. A spark plug comprising:

an insulator including a tubular portion disposed along a center axis and having an outer circumferential surface, a leg portion smaller in outside diameter than the tubular portion and having an outer circumferential surface, and a step portion having an outer circumferential surface which connects the outer circumferential surface of the leg portion and the outer circumferential surface of the tubular portion;

a center electrode disposed inside the insulator along the center axis;

a tubular metallic shell including a trunk portion disposed radially outward of the tubular portion of the insulator and having an axially forward end and an inner circumferential surface with cutting traces formed thereon, a ledge portion integral with and protruding radially inward of the axially forward end of the trunk portion with a rear end surface of the ledge portion facing the outer circumferential surface of the step portion of the insulator, and an elongated leg portion integral with the ledge portion, disposed radially outward of the leg portion of the insulator, and having an inner circumferential surface with cutting traces formed thereon;

a packing disposed between the step portion of the insulator and the ledge portion of the metallic shell, the packing including a first portion disposed between, and in contact with, the rear end surface of the ledge portion of the metallic shell and the outer circumferential surface of the step portion of the insulator, and a second portion disposed between, and in contact with, the inner circumferential surface of the trunk portion of the metallic shell and the outer circumferential surface of the tubular portion of the insulator; and a ground electrode connected to the metallic shell and facing the center electrode.

2. The spark plug according to claim 1, wherein, in a section taken along and containing the center axis, a first axial length of the second portion of the packing as measured on the outer circumferential surface of the tubular portion of the insulator is taken from a first imaginary straight line orthogonal to the center axis and passing through a connection point between the outer circumferential surface of the tubular portion and the outer circumferential surface of the step portion of the insulator, a second axial length of the second portion as measured on the inner circumferential surface of the trunk portion of the metallic shell is taken from the first imaginary straight line, and a value obtained by dividing the shorter of the first axial length and the second axial length by a distance as measured on the first imaginary straight line between the connection point and the inner circumferential surface of the trunk portion of the metallic shell is 0.3 or greater.

3. The spark plug according to claim 2, wherein, in the section taken along and containing the center axis, the first axial length is longer than the second axial length.

4. The spark plug according to claim 2, wherein, in the section taken along and containing the center axis, a value obtained by dividing a third axial length of the first portion of the packing as measured on a second imaginary straight line passing through the connection point and being parallel with the center axis by the distance as measured on the first imaginary straight line between the connection point and the inner circumferential surface of the trunk portion of the metallic shell is 2.0 or less.

5. The spark plug according to claim 3, wherein, in the section taken along and containing the center axis, a value obtained by dividing a third axial length of the first portion of the packing as measured on a second imaginary straight line passing through the connection point and being parallel with the center axis by the distance as measured on the first imaginary straight line between the connection point and the inner circumferential surface of the trunk portion of the metallic shell is 2.0 or less.

* * * * *